United States Patent [19]

Smith

[11] 4,003,619

[45] Jan. 18, 1977

[54] BUS CONNECTORS

[76] Inventor: Walter A. Smith, 3607 Sausalito, Los Alamitos, Calif. 90720

[22] Filed: Apr. 4, 1975

[21] Appl. No.: 565,228

Related U.S. Application Data

[63] Continuation-in-part of Ser. No. 432,708, Jan. 11, 1974, abandoned.

[52] U.S. Cl. ..... 339/22 B; 339/DIG. 1

[51] Int. Cl.[2] ..... H01R 9/00

[58] Field of Search ..... 339/20, 21 R, 22 R, 339/22 B, 254 R, 254 M, 256 R, 256 C, 256 SP, DIG. 1

[56] References Cited

UNITED STATES PATENTS

| | | | |
|---|---|---|---|
| 2,912,666 | 11/1959 | Hurvitz | 339/256 |
| 2,981,926 | 4/1961 | Boardman | 339/22 B |
| 3,495,139 | 2/1970 | Brown | 339/DIG. 1 |
| 3,582,864 | 6/1971 | Sullivan | 339/DIG. 1 |
| 3,708,608 | 1/1973 | Wyman | 339/96 |

FOREIGN PATENTS OR APPLICATIONS

| | | | |
|---|---|---|---|
| 1,202,373 | 10/1965 | Germany | 339/22 P |

*Primary Examiner*—Roy Lake
*Assistant Examiner*—Mark S. Bicks
*Attorney, Agent, or Firm*—Grover A. Frater

[57] ABSTRACT

An electrical bus bar is disclosed which is formed of two parallel bars that lie together in juxtaposition in parallel planes except where conformations in one or both bars result in their separation to form a region into which a connector pin can be inserted. A means is provided for holding the two bars of the bus bar together so that they grip the connector pin after the pin is inserted into the connection position. Several means are disclosed for holding the bars together. The preferred means for that purpose is a non-conductive, resilient material which encompasses the two bars that form the bus bar and grips them together sufficiently to pinch the two bars against opposite sides of a connector pin with which they are assembled.

8 Claims, 16 Drawing Figures

FIG. 1
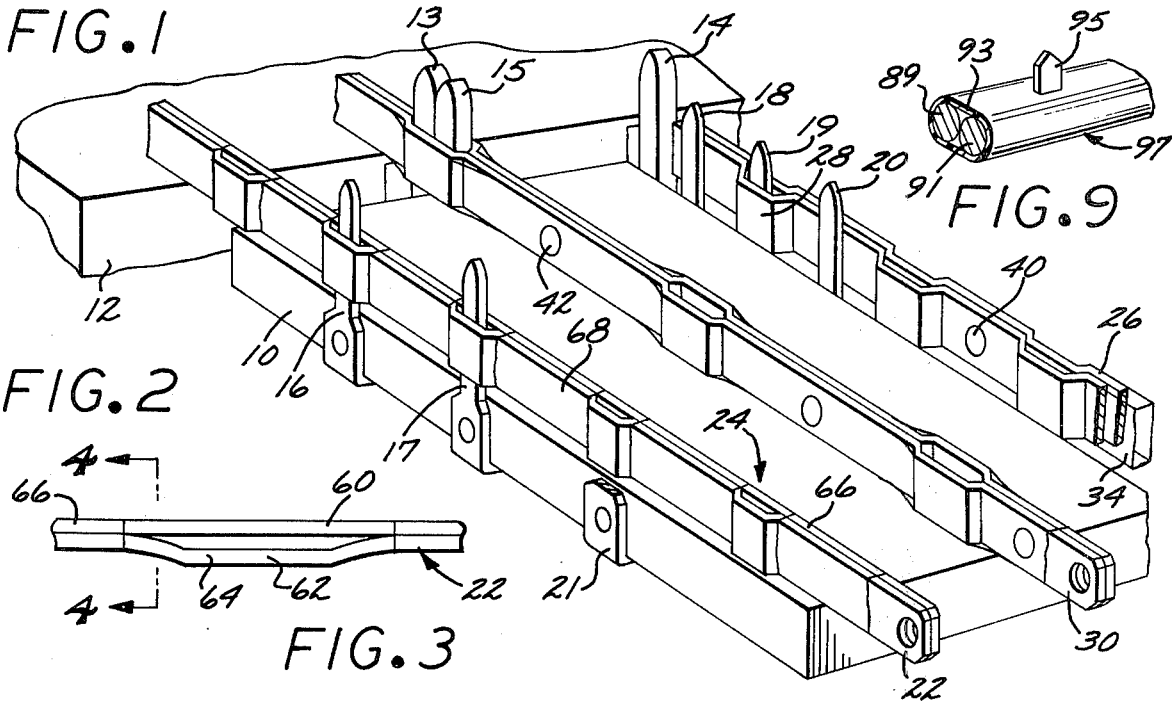
FIG. 9
FIG. 2
FIG. 3
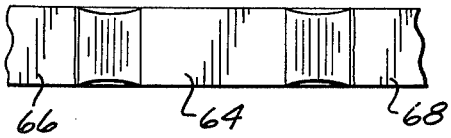
FIG. 4
FIG. 5
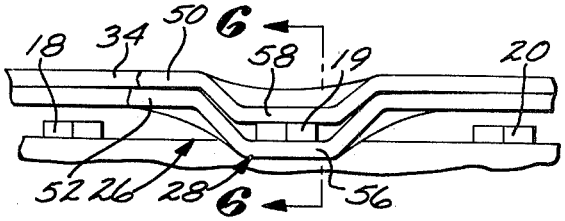
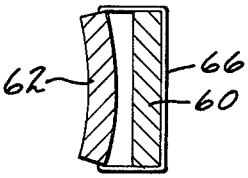
FIG. 6
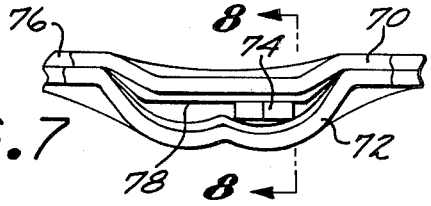
FIG. 7
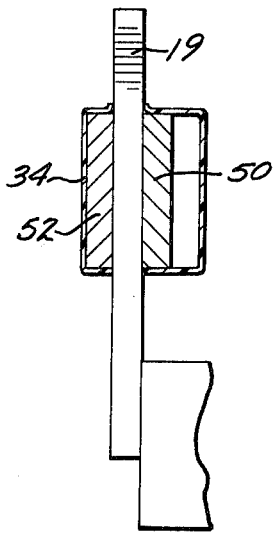
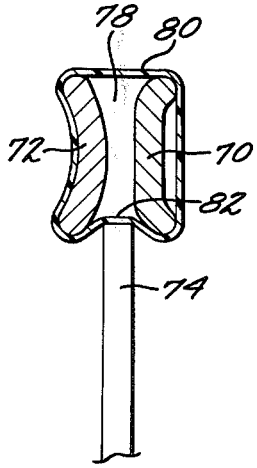
FIG. 8
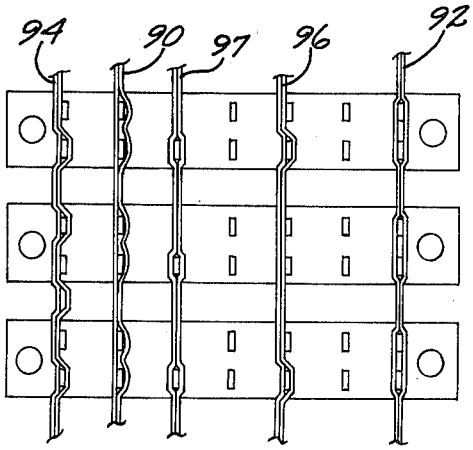
FIG. 10

FIG. 13
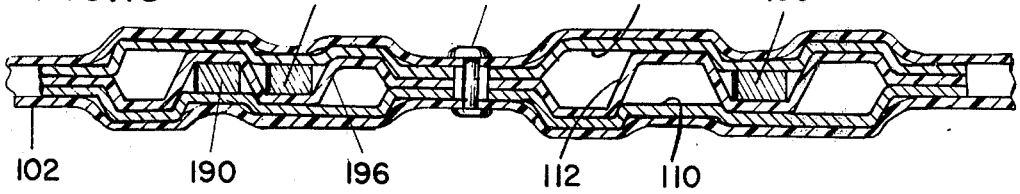
FIG. 12
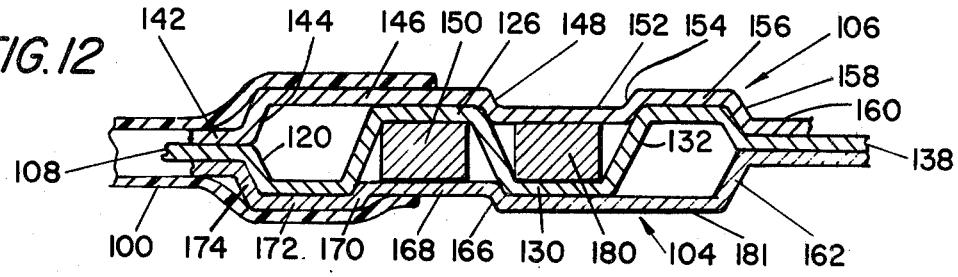
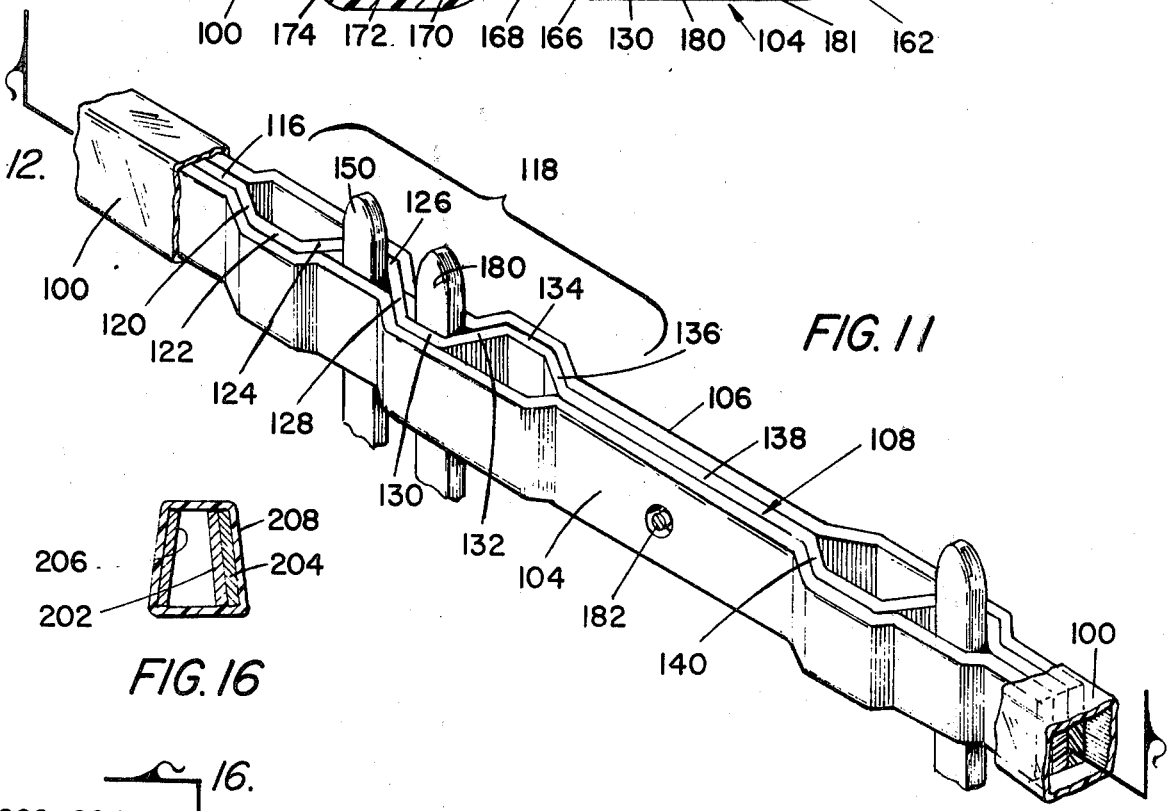
FIG. 11
FIG. 16
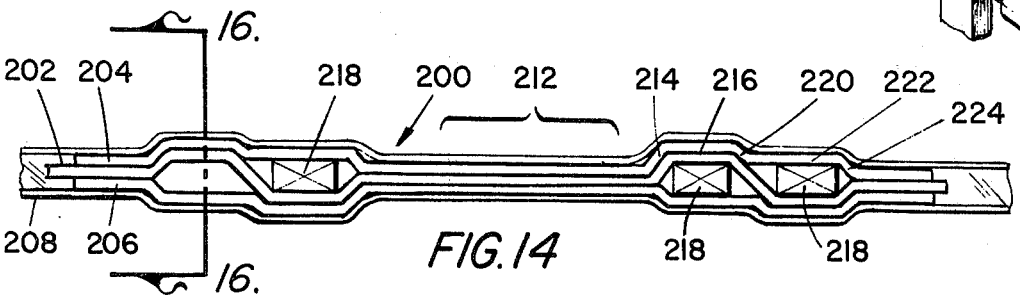
FIG. 14
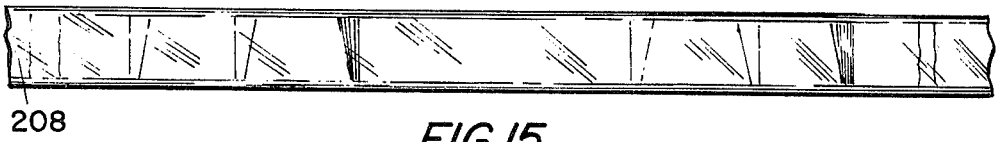
FIG. 15

BUS CONNECTORS

This application is a continuation-in-part of application Ser. No. 432,708, filed Jan. 11, 1974, now abandoned.

This invention relates to improvements in electrical bus bars. An electrical bus is defined as a major conductor for distributing power within an electrical instrument or apparatus or switching center. The term is usually reserved for common conductors that connect one terminal of each of the number of pieces of apparatus to a common potential. Unlike the chassis ground, an electrical bus usually is formed as a bar or strip which is connected at points along its length to several terminals or pieces of apparatus. Indeed, the electrical bus is often called a "bus bar".

Formally used primarily in power distribution and control systems, the bus bar has now found application in electronic assemblies. The advent of integrated circuitry, circuit boards, and other modular construction techniques, has led to the use of connector pins which are arranged in rows with standard spacing. That makes it possible to use bus bars for interconnecting commom terminals in lieu of point-to-point wiring or printed circuit runs. Use of the bus bar is especially advantageous in case of removable, plug-in components.

Whereas bus bars in power systems commonly used nuts and bolts to complete the electrical connections, the bus bar in the electronic apparatus generally makes contact by frictional engagement with connector pins. In one kind of electrical bus bar intended for use with electronic apparatus, the bar comprises a strip of metal which is lanced at spaced regions along its length. The metal at the lanced region is bent so that it will engage a connector pin and grip it. The bus material in the region of the lancing is extruded or bent in a way so that it engages the connector at opposite sides. A material is used that exhibits a spring characteristic. The conformation is such that the material must be spread somewhat when the bus is forced onto the connector. Because of its resilience, the bus material squeezes the pin to complete and maintain both an electrical and a mechanical connection. The best bus bar materials from the standpoint of cost and conductivity are copper and aluminum. However, these materials must be alloyed with other metals to make springs of them. The alloys are substantially less conductive, and for that reason are very much less desirable than the pure metals. Moreover, it is difficult to secure uniformity in the resilient quality of such a bus bar both because it is difficult to maintain dimensional control of the variables that have an effect upon stiffness and because it is difficult to maintain uniformity in the alloying process. The most nearly satisfactory products are made from beryllium copper. That material is suitable for making electrical conductors although its conductivity is much less than that of copper alone. Moreover, uniformity of resilience in a beryllium copper bus is very difficult to control.

The problem is accentuated because the spacing between successive connections in a bus associated with electronic circuitry is often sufficiently small so that the use of cantilever springs and other expedients that are commonly used to overcome the affect of dimensional variation and physical characteristic variation is impractical. Not only must the bus bar connect selected terminals together, but it must avoid connection with other terminals. That requirement imposes further restrictions on use of the portions of the bus bar intermediate connections in solving the problem of providing adequate clamping without imposing tolerance limits that are difficult to meet.

The invention solves those problems. Instead of relying on precision conformation lancing and shaping in a single bar, bus bars made according to the invention employ two bars arranged substantially in parallel. The bars are secured together in the regions intermediate connection points and they are spaced apart at the connection points sufficiently so that the connector pin to be engaged can be forced between the two bars. It remains only to secure the two bars together in the regions intermediate points so that a resilient force is applied to urge the bars together at the connection point.

The invention contemplates serveral structural arrangements for accomplishing that function. In a preferred embodiment the two bars that comprise the bus are held together by a band of elastomeric material which encompasses the two bars and holds them together. It is necessary that the elastomer be stretched so that it exhibits renitence at those points at which the bus is assembled on a connector. In the preferred embodiment, there is some stretching and the two bars of the bus are squeezed together even in the at rest condition in which the bar is not assembled with a connector. However, that quality is not essential; it is enough that the resilient force is exhibited when the bus is assembled with a connector.

In the preferred embodiment, the elastomeric material forms a sheath which covers the bus bar from end to end. The preferred way of forming that sheath is to place a length of heat shrinkable tubing over a pair of bars that together are to form the bus and the to apply heat to the tubing sufficiently to shrink it. There are a number of plastic materials that shrink in considerable degree when heated. While their physical characteristics differ, they are electrical insulators and most of them will shrink to the point to which they are stretched when they come to rest so that they do exhibit a renitence by which the bars are gripped together in the at rest condition before being assembled with a terminal. The fact that the elastomeric material is electrically non-conducting is advantageous because it serves to insulate the bus from inadvertent electrical contact with other connectors and apparatus.

For that purpose, it makes no difference whether the elastomeric material be applied over selected areas of the bus or whether it extends over the whole length of the bus as in the case of a sheath. However, the use of a sheath of plastic material which encompasses that portion of the bar at which an electrical connection is to be made has another very distinct advantage. The two bars that together form the bus bar are spread apart and are physically separated at the point at which the bus is to be assembled with a connector. The sheath is stretched across the connection space to form a sheet of resilient material. The sheath will be pierced when pressed against the connector terminal to which the bus is to be connected. However, a plastic material is selected which has sufficient shear strength to offer some resistance to being pierced when pressed against a terminal. The end of the terminal will bear against the sheet tending to stretch it. At the same time, there will be a lateral force urging the connector terminal toward the central area of the sheet and the central area of the connection space. As a consequence, there is a self centering action that serves to force the connector pin into alignment with the connection portion of the bus, whereby assembly is greatly facilitated. Flouro plastics make an excellent sheath because their lubricity aids greatly in accomplishing that kind of centering. The use of such a sheath makes it possible to complete a substantial number of connections simultaneously by pressing a bus bar down against the several connectors of an electronic assembly. At the same time, the lubricity of the plastic sheath aids in fitting or sliding the bus past connectors and elements to which it is not to be electrically connected.

In another form of the invention, three bars are arranged in parallel so that the bars may be applied to interconnect terminals that fit between pairs of those three bars. The center bar is shaped so that it can meander from one side of one terminal to the opposite side of another. It may be made of insulating material whereby adjacent terminals can remain insulated from one another if the center bar, or strip, is formed of a nonconductor of electricity.

The invention will be readily understood by reference to the drawings which show several embodiments of the invention. It is to be understood, however, that these several embodiments illustrate the invention rather than define its limits and that other embodiments of the invention are possible.

In the drawings:

FIG. 1 is a fragment of an electronic assembly including several bus bars which embody the invention;

FIG . 2 is a top plan view of a fragment of one of the bus bars of FIG. 1;

FIG. 3 is a view in front elevation of the fragment shown in FIG. 2;

FIG. 4 is a cross-sectional view taken on line 4—4 of FIG. 2;

FIG. 5 is a top view of a fragment of another of the bus bars of FIG. 1;

FIG. 6 is a cross-sectional view taken on line 6—6 of FIG. 5;

FIG. 7 is a top view of a fragment of an alternative form of bus bar;

FIG. 8 is a cross-sectional view taken on line 8—8 of FIG. 7; FIG. 9 is a sectional, pictorial view of a fragment of another form of bus bar shown assembled on a connector;

FIG. 10 is a top plan view of a portion of an electronic assembly which includes several bus bars made according to the invention;

FIG. 11 is an isometric view of a fragment of a bus bar of still another embodiment of the invention;

FIG. 12 is a cross-sectional view of a portion of the structure of FIG. 11 taken on its horizontal mid-plane;

FIG. 13 is a cross-sectional view of a modified form of the bus bar of FIG. 11 shown with its plastic sleeve cross-sectioned;

FIG. 14 is a top plan view of another modification of the bus bar of FIG. 11;

FIG. 15 is a view in side elevation of the bar of FIG 14; and

FIG. 16 is a cross-sectional view taken on line 16—16 of FIG. 14.

The assembly of FIG. 1 includes an electronic component 10 and another electronic assembly 12. Only a fragment of the latter is shown. Assembly 12 includes two pin-type terminal connectors 13 and 14. The assembly 10 includes a similar style of pin connector which is identified by the reference 15. In addition, the electronic assembly 10 includes a number of sword-style connector pins which are fixed in rows along its edges. Pins 16 and 17 are secured to the near edge (in FIG. 1) of the assembly 10 and pins 18, 19 and 20 are disposed along the far edge. Assembly 10 is an example of the kind of electronic component that is pre-packaged in standard form and is arranged so that the manufacturer who incorporates it in a larger assembly can use all or only part of its circuitry. In this case, some of the pins are to remain unconnected and some of them have been cut away before being assembled with the bus bar. Thus, the numeral 21 identifies a connector whose pin has been cut away prior to installation of the bus bar 22. The pin connector was not to be connected to the bus. It was cut away because the bus bar 22 is formed with a region 24 which the cut away pin would have engaged. On the other hand, pins 18 and 20 were not cut away, although it is intended that they be insulated from the bus. Bus bar 26 is formed with a portion 28 which embraces and makes electrical contact with pin 19, but the bus bar 26 is formed so that it does not have any portion that engages the pins 18 or 20. Instead, bus bar 26 formed so that it clears and does not touch those pins 18 and 20. They are simply left unconnected and undisturbed. The bus bar 26 clears pins 18 and 20 in only a small degree. However, bus bar 26, like bus bar 30, is covered with a continuous sheath of non-conducting plastic material which prevents electrical contact between it and either of the pins 18 or 20 notwithstanding the fact that those pins might become bent and physically engage the bus bar sheath.

The sheath is made of a transparent material. That transparency is not essential to success of the invention, but it is an important feature of the invention because it permits a visual determination of whether the connecting portions of the bus bar are properly oriented relative to the pins to which they are to be attached. The margins of the sheath are visible in the drawings particularly at the right hand of bus bar 26 where the sheath is identified by the reference 34.

The bus bar 22 does not have a continuous sheath. It is formed with a number of connecting portions along its length, such as the connecting portion 24. Between those connecting portions, the bus bar is circled and encompassed, and its parts are gripped together, by bands of elastomeric plastic material which does not need to be, and is not, transparent.

In the case of each of these bus bars, the completed bus bar assembly includes two bars arranged with their broad sides side by side in juxtaposition. One or both of the bars has conformations along its lengths in which a portion of the bar will be displaced out of that plane whereby a space will be formed into which a connector terminal can be forced. The assembly also includes a means by which the two bars are squeezed toward one another at that offset portion so that the two bars will be squeezed against opposite sides of a connector terminal when disposed between them. It is necessary to successful operation of bus bar that it be electrically conductive. Only one of the two bars that make up the bus bar assembly need be conductive so that one bar may be made of an electrically conductive material and the other may be made of a non-conductor. It is not essential that the conductive bar be made entirely of a conductive material if it is provided with a conductive overlayer on that side of the bar that faces its companion bar.

In FIG. 1, the bus bar 26 is formed of two bars of soft drawn copper. The bus bar 30 is formed of one metallic bar and one plastic bar. The metal bar is made of soft drawn copper and the other is made of a resilient plastic material which is coated with an overlayer of copper on the side that faces the copper bar. The bus bar 22 is formed of two bars of hard drawn copper material so that they exhibit some resilience.

The bus bar 26 is arranged so that the two bars are spot welded together at points along their length intermediate the connecting portions. For identification, one of the spot welded areas is numbered 40 in FIG. 1. The two bars that comprise the bus bar 30 are riveted together at points along their length between the connecting portion of the bus. For identification, one of the rivets has been numbered 42 in FIG. 1. To the extent that the bars that together form a bus bar have resilience, the fastening means 40 and 42 will serve as the means for biasing the two bars together more accurately, and they serve to hold the bars so that any force to separate them at the connector portions will be opposed by the renitence exhibited by the bar as an incident to its resilience.

The resilience of the bars in bus bar 26 is not adequate to insure good electrical contact at the connecting portions because the bars are made of soft drawn copper. The spot welding is supplemented with the sleeving sheath 34. That sheath is made of a plastic material that shrinks greatly upon being heated. The bus bar is inserted into the tube made of that material. Thereafter, the tube is heated and made to shrink so that it grips the two bars and squeezes them together. A portion of that bus bar is shown enlarged in FIG. 5. The upper bar 50 and the lower bar 52 have the same cross-sectional shape. That may be seen in FIG. 6. They are held tightly together by the sheath 34. The sheath does not hug the bars in the contact region 28, but is stretched so that it spans the recessed portions of the conformations of the two bars. For identification, the offset portion of bar 52 is designated 56 and the offset portion of bar 50 is designated 58. Portion 56 is offset from the plane of bar 50 in greater degree than portion 58 is offset from its bar 50. The result is that a space is provided between offset portions 56 and 58 and it is in that space that the contact pin 19 is disposed when the bus bar is assembled over the pin. In the absence of the pin 19, the spacing between offset portions 56 and 58 would be less than it is shown to be in FIG. 5. It would be less because the sheath 34 would squeeze the bars together whereby that space would be smaller. When the connector pin 19 is inserted, the bars tend to separate at the connector region and the sheath 34 is stretched against its resilience whereby the bars are made to grip the connector pin and a mechanical and an electrical contact is completed. Bus bar 26 is made with both of its bars having offset portions in the connection region so that the connection region will lie in a plane spaced from the plane of the bar in the space between connection sections. Because of that construction, the bus bar will clear a connector pin that lies in the plane of the pins at a point spaced from the connection portions of the bus. That is apparent in FIG. 5 because the bus bar clears pins 18 and 20, notwithstanding that the pin 19, which is engaged by the bus bar, lies in the same plane as do pins 18 and 20.

The bus bar 22 does not include that feature. Its upper bar 60 does not have offset portions. Instead, it lies in only one plane along its entire length. However, the companion bar 62 does have offset portions at regions along its length at which connections are to be made. One of those connection regions is shown in FIG. 2 where the bar 62 has an offset portion 64 that is spaced from bar 60. The spacing is less than the width of the pin to which that bus bar is intended to be connected. In this case the two bars of the bus are held together by resilient bands of material that encompass the two bars at points intermediate the connection regions. The band at the left of the connection region in FIG. 2 is designated 66 and the band at the right is designated 68. These bands are made of a resilient plastic material. The band was formed in situ during manufacture. The bus was coated with a plastic material that subsequently solidified and attempted to shrink. Being precluded from shrinking, it solidified into a band that was stretched to a peripheral size greater than what its size would be if freed from the bus bar.

It will be apparent from an examination of FIGS. 2, 3 and 4, that the offset portion 64 is arcuate in cross-section at its sides. That is, that portion of the bar that extends laterally to form the offset portion is curved outwardly away from bar 60 at its upper and lower edges whereby to increase the area of the space between the two bars at the upper and lower edges of the bus. That facilitates locating and assembling the bus bar on a connector terminal. That same expedient is used in the embodiment shown in FIGS. 7 and 8. Here, the bar 70 and the bar 72 are bent outwardly at their upper and lower margins each in a direction away from the other bar to form a wider mouthed opening between the two bars at the connection region. In FIGS. 7 and 8, the connector pin 74 is not inserted in the bus bar connection portion but is disposed immediately below it. Examination of those figures will show that the connector pin 74 is wider than the space between the two bars of the bus. When the pin is forced up into the space between the two bars, the transparent sheath 76 will be stretched to permit separation of the bars. However, the resilience of the sheath will cause the bars to squeeze against the pin. While not immediately apparent in FIG. 7 because the sheath 76 is transparent, a portion of the sheath is stretched across the space 78 between the two bars above their upper edge and below their lower edge. The portion of the sheath that is stretched above the upper part of the space is designated 80 in FIG. 8 and the portion that is stretched across the lower entrance to that space is designated 82. The sheath is resilient and it stretches. If the pin 74 in FIG. 8 is forced upwardly toward the space 78, it will bear against the lower surface of the sheath at 82. That sheath has sufficient sheer strength so that the sheath will be indented in substantial degree before it tears. Indenting of the sheath will force it to somewhat cone-like shape as depicted in FIG. 8 and lateral forces acting on the pin will tend to push it to alignment with the center of space 78 if it was not so aligned initially. When the sheath finally tears to permit entry of the pin 74 into the space, the pin will be aligned for easy entry. Thus, the sheath 82 facilitates assembly by serving to help align the pin with the bus bar connector opening. Many plastic materials exhibit relatively high degree of lubricity and one of those materials is advantageously selected for that quality so that the end of the connector pin 74 will slide over surface easily toward the center of the space 78.

The bus bar 97 of FIG. 9 achieves a similar result. It is formed by two round, or nearly round, wires 89 and 91 which are held together by an encircling sheath 93 of plastic. As in the other embodiments, a high shear strength plastic is employed which does not tear when pierced. The wires are made of relatively soft metal that binds readily to accommodate a thin contact such as contact 95.

The bus bar of FIGS. 7 and 8 and the bus bar 30 in FIG. 1 are arranged so that pairs of connector pins are accommodated at each connection portion along the bus bar. Bus bars of that kind are illustrated in FIG. 9 where they are identified by reference numerals 90 and 92. Bus bars 22 and 26 are arranged so that only one connector pin is accommodated at each connection region. Bus bars 94 and 96 of FIG. 10 are that kind. The bus bar 97 need not have offset regions along its length, although as shown in FIGS. 9 and 10, offsets are effectively formed as shown at the points where the bar is assembled on a connector.

Referring to FIGS. 11, 12, and 13, the bus bar there shown includes three bars, or strips. In FIGS. 11 and 12, all three bars are electrically conductive. In FIG. 13, the center bar is made of an electrically insulating material. Except for that difference, and the difference, and the fact that the rivets that hold the assembly together in FIG. 13 are insulated from the two outer bars, whereas the rivet that holds the three bars together in FIG. 11 is not so insulated, the two forms are the same. In both cases, the bus bar is entirely covered with a sheath of plastic heat shrinkable tubing. That tubing is identified by the reference numeral 100 in FIGS. 11 and 12, and it is identified by the reference numeral 102 in the case of FIG. 13. The bar at the left in FIG. 11 is designated 104. It is the lower bar in FIG. 12. The upper bar in FIG. 12 is numbered 106 and that is the one on the right in FIG. 11. The center bar in FIGS. 11 and 12 is identified by the reference numeral 108.

In FIG. 13, the lower, outer bar is identified by the reference numeral 110. The center bar 112 is made of a resilient plastic material which is an electrical insulator. The other bar, the upper one, 114, is conductive as is bar 110.

In the embodiment of FIGS. 11 and 12, the bar 104 is shaped like bar 106 except that the two bars are arranged back to back. The same is true of bars 110 and 114 in FIG. 13. In both forms, the center bar, or strip, meanders in the region that has been called the offset section. Between offset sections, the bar is straight. The plane in which the section between offset sections lies is called the mid-plane of the bar.

Referring to FIG. 11, the portion 116 of bar 108 lies in that mid-plane at the left of the offset section which is generally designated by the reference number 118. A first segment 120 of the middle bar is bent leftward at an angle from the mid-plane. Thereafter, in another section 120, the bar is bent into a plane substantially parallel with the mid-plane. The following section 124 is bent at an angle so that it extends back across the mid-plane to the opposite side of the plane where it is again bent into a section 126 which is parallel with the mid-plane and lies at a distance from it substantially equal to the distance at which section 122 lies from the mid-plane. The following section 128 is bent at an angle and extends across the mid-plane where it is bent into a section 130 which lies in a plane substantially parallel to the mid-plane and coincident with the plane of section 122. Thereafter, the bar is bent at a section 132 back across the mid-plane where it is bent again into a section 134 which lies substantially parallel to the mid-plane and coincident with the plane of section 126. Finally, the bar is bent backward at an angle in a section 136 toward the mid-plane where it is bent again to lie in the mid-plane. The section that lies in the mid-plane at the right of the offset section 118 is identified by the reference numeral 138. At the right end of the section, the center conductor is bent at a section 140 out of the mid-plane toward the left. Section 140 corresponds to section 120 and the bar is bent, beginning at section 140, to reproduce the configuration through the offset section 118.

It is possible within the invention to omit sections 120, 122 and the first portion of section 124, and to continue section 116 in the mid-plane of the bar until its intersection with section 114. That same thing is true with respect to the conformations at the other end of the offset section where section 138 could be continued in the mid-plane of the bar to the intersection with section 132. The outer bars are wrapped around the sections 120 and 122 and 124 and 132, 134 and 136, and if the bar is straightened at those regions, the outer bars may also be straightened. However, the construction shown is preferred because it makes better use of the resilience of the several bars in clamping against the connectors with which the bar is associated. Even if the center bar is modified, as indicated, it is preferred that the modifications be made symmetrically so that with respect to an imaginary plane, extending vertically through the bar transversly through the mid-point of the offset section, the bar on one side of the plane is the mirror image of the other. That arrangement simplifies assembly because the bar is exactly the same, even though turned end to end.

Turning to FIG. 12, the shape of the outer bar is described as follows. In the region between offset sections, section 142 of bar 106 lies with its flat side adjacent to and in abutment with one side of the center bar 108. At the point at which the section 116 is bent out of the midplane at section 120, the upper bar is bent at a like angle out of its basic plane in a section 144. It is bent at the same angle at which the section 120 is bent. Thereafter, bar 106 is bent back in a plane parallel to the base plane in which section 142 lies at its section 146. At the point at which the section 126 of the center bar passes the terminal 150 and becomes section 128, bar 106 is bent from section 146 to a section 148 which is substantially parallel with section 120. Section 148 does not extend entirely to the base plane in which section 142 lies. Instead, it terminates at a point at which the bar 106 is bent parallel to the base plane. However, section 152 lies in a plane intermediate the base plane and the plane of section 142. At the point where section 152 abuts, or nearly abuts, section 132 of the center bat, it is again bent in a section 154 away from the base plane. Thereafter, it is bent into a section 156 which lies substantially parallel to the base plane bar 106 and coincident with the plane of section 146. Thereafter, bar 106 is bent in a section 158 back toward the base plane, and at the base plane it is bent into the base plane in a section 160 which is the section between the offset section 118 and the subsequent offset section of the composite bus bar. Section 160 lies adjacent to and flat against section 138 of the center bar.

As previously indicated, bar 104 is simply the reverse of bar 106. Sections 162, 164, 166, 168, 170, 172 and 174 correspond to sections 144, 146, 148, 152, 154, 156 and 158, respectively. In relaxed condition, all of the offset portions lie parallel to one another, or substantially so. That that is not entirely true in FIG. 12 is accounted for by the fact that the bus bar assembly has been assembled on the connectors 150 and 180. Those connectors have a width that exceeds in small degree the spacing between sections 126 of bar 108 and section 168 of bar 104, and between section 152 of bar 106 and section 130 of the center bar 108.

The bus bar assembly is clamped to the connectors by a biasing force. In this embodiment, the three conductors are riveted together by a series of rivets, one of which is visible in FIG. 11 where it is designated by the numeral 182. That rivet is located in the straight region of the bus bar between offset sections. In addition to holding the three bars together, that rivet clamps the plastic sheath to the bars. The sheath is transparent in FIG. 11 so that it is not apparent that it encompasses the entire bus bar except that portions of the sheath 100 are visible at each end of the fragment shown.

A similar rivet 184 is used to clamp together the sheath and the three bus bars in FIG. 13. The rivet is the same as it is in the case of the embodiment of FIGS. 11 and 12. However, the opening in bar 114 and in bar 110 in which that rivet is accommodated, is larger than the outside rivet diameter. The opening in the center conductor through which the rivet passes has a diameter substantially equal to the diameter of the rivet. As a consequence, the rivet is held insulated from bar 114 and from bar 112. Since the center bar is made of an insulating material, bars 110 and 114 are electrically insulated from one another.

In the case of FIGS. 11 and 12, the connectors 150 and 180 are interconnected electrically by the composite bus bar. In FIG. 13, connector 190 is in electrical contact with bus bar 110, but it is insulated from bar 114 by section 192 of the center bar. Connector 194 makes electrical contact with bar 114, but it is insulated from bar 110 by section 196 of the insulating center bar 112. Connector 194 is electrically connected to terminal 196 because that terminal is pinched between bars 114 which is conductive and bar 112. Since the latter is an insulator, connector 196 is electrically isolated from bar 110.

It was mentioned above that the end sections 120, 122, 124 and the corresponding sections at the other end of the offset portion of the bar shown in FIGS. 11 and 12 may be omitted. A bar 200 of that kind is shown in FIGS. 14, 15 and 16. Bar 200 consists of three conductors: a center one 202, an upper one (in FIG. 14) 204, and a lower one 206. Bar 202 may be turned end for end. Bars 204 and 206 may also be turned end for end or interchanged. However, none of them may be turned bottom edge up because they are formed so that the openings they define when assembled are wider at the bottom edge than at the top edge. That feature is shown in FIG. 16.

The whole assembly is encompassed in a plastic sheath 208. The sheath, like those previously described, is made of a material that shrinks when treated. It shrinks sufficiently so that the conductors are held together tightly and held to conductor pins on which the bar may be assembled. To facilitate assembly, the conductors also may be united together or bonded together with an adhesive. These are so bonded. The several conductors are tinned along their length and they are bonded together by being "sweated" together in the region 212 between offset sections. The solder layer is so thin that it is not separately discernable in the drawing.

For identification, the offset portion of conductor 204 includes a section 214 which extends at about 45° from the plane of the conductor to a section 216 which lies parallel to that plane at a distance approximately equal to one half the thickness of the connector pins 218. That section joins a section 220 which extends at about 45° back toward said plane. It joins a section 222 parallel to said plane at a distance which is approximately equal to said plane, less the width of center conductor 202. Thereafter, the conductor 204 is bent at about 45° at section 224 back to the plane of conductor 204.

As best shown in FIG. 15, the several bends that form the offset section are made such that the offset sections will be separated in greater degree at their lower edges.

The center conductor 202 is offset in both directions from its center plane a distance of half the width of the connectors 218. The center conductor nests in the conformations of the two side conductors when assembled.

Although I have shown and described certain specific embodiments of my invention, I am fully aware that many modifications thereof are possible. My invention, therefore, is not to be restricted except insofar as is necessitated by prior art.

I claim:

1. A bus bar for making connection to connectors which are arranged in a line comprising, in combination:

at least three bars extending side by side such that a first outer bar and a second outer bar lie on opposite sides of a middle bar;

said middle bar being formed at a region along its length such that it meanders to one side and then to the other side of a plane lying between said first and second bars; and compression means for compressing said bars toward one another, said compression means comprising a sheath encompassing said bars.

2. The invention defined in claim 1 in which all three bars are electrically conductive.

3. The invention defined in claim 1 in which the middle bar is an electrical insulator.

4. The invention defined in claim 1 in which said middle bar lies in a plane on opposite ends of said region and at said region is bent first to one side of said plane and then across the plane to the other side of said plane and then back to said plane.

5. The invention defined in claim 4 in which said middle bar is shaped symmetrically about said plane in said region in the sense that its shape is the same when turned end for end.

6. The invention defined in claim 4 in which each of said first and second bars is offset in said region such that it engages said middle bar at points at which the middle bar is bent toward it and does not engage said middle bar at points at which the middle bar is bent away from it.

7. A bus bar for making connection to connectors which are arranged in a line comprising, in combination:

at least three bars extending side by side such that a first outer bar and a second outer bar lie on opposite sides of a middle bar;

said bars extending, in the direction of their length, such that the first bar lies on one side of a plane and said second bar lies on the opposite side of said plane and such that said middle bar lies on said plane for portions of its length;

said first and second bars being displaced at one region along the length of said bus bar at a greater distance from said plane than at another region along said bus bar;

said middle bar being formed in said one region such that it meanders to one side and then to the other side of said plane such that in one portion of that region it engages only said one bar and in another portion of said one region it engages only said second bar.

8. The invention defined in claim 7 which further comprises compression means in the form of a resilient sheath encompassing said three bars for compressing said three bars toward one another.

* * * * *